US007753689B1

(12) United States Patent
Wu

(10) Patent No.: US 7,753,689 B1
(45) Date of Patent: Jul. 13, 2010

(54) PLUG CONNECTOR WITH RIGHT ANGLE COVER

(75) Inventor: Jerry Wu, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/454,069

(22) Filed: May 12, 2009

(51) Int. Cl.
*H01R 12/00* (2006.01)

(52) U.S. Cl. ..... 439/63; 439/490; 439/607.46

(58) Field of Classification Search ..... 439/63, 439/76.1, 490, 581, 582, 607.46, 607.5
See application file for complete search history.

(56) References Cited

U.S. PATENT DOCUMENTS 4,655,534 A * 4/1987 Stursa ..... 439/582
6,582,252 B1 * 6/2003 Lin ..... 439/607.46
6,663,415 B1 * 12/2003 Wu ..... 439/460
7,247,046 B1 * 7/2007 Wu ..... 439/490
7,491,087 B2 * 2/2009 Swantner et al. ..... 439/582
7,540,773 B2 * 6/2009 Ko ..... 439/581
7,654,856 B2 * 2/2010 Wu ..... 439/460

* cited by examiner

*Primary Examiner*—Thanh-Tam T Le
(74) *Attorney, Agent, or Firm*—Wei Te Chung; Andrew C. Cheng; Ming Chieh Chang

(57) ABSTRACT

A plug connector for mating with a complementary connector includes a mating plug connector and an electrical connector. The mating plug connector includes a housing, a plurality of contacts received in the housing and spaced apart from each other, and a grounding shield surrounding the housing. The electrical connector is perpendicular to the mating plug connector and includes a metal cover, and an electric substrate received in the metal cover and electrical connected to the contacts of the mating plug connector.

4 Claims, 6 Drawing Sheets

PLUG CONNECTOR WITH RIGHT ANGLE COVER

BACKGROUND OF THE INVENTION

1. Field of the Invention

The present invention relates generally to a plug connector, and more particularly to a plug connector assembled with right angle cover.

2. Description of the Prior Art

Electrical interconnection is generally made by two connectors, i.e. a plug connector and a mating female connector. In general, the female connector sits on the electronic device, while the plug connector is terminated at an end of a cable.

Direct current (DC) power plug connector is one type of electrical plug connections used to provide DC power for electrical apparatus. Reference to FIG. 1, a prior art DC power cord cable assembly 100' with a LED is shown. The DC power cord assembly 100' comprises a mating plug connector 4' and an insulative housing 1' received one end of a cable 6', some electrical components (not shown) are disposed in the housing 1' for connection of the cable 6' and the mating plug connector 4', and a LED pilot lamp 511'. However, the conventional DC power plug connector is not adapted to mate with some electrical devices which need right-angle typed connector. And the housing is made of dielectric material so as not to benefit for resist Electro Magnetic Interference and Electro Static Discharge.

Hence, in this art, a plug connector to overcome the above-mentioned disadvantages of the prior art should be provided.

BRIEF SUMMARY OF THE INVENTION

A primary object, therefore, of the present invention is to provide a plug connector with right angle cover.

In order to implement the above object, the plug connector, mated with a complementary connector, comprises a mating plug connector and an electrical connector. The mating plug connector comprises a housing, a plurality of contacts received in the housing and spaced apart from each other, and a grounding shield surrounding the housing. The electrical connector is perpendicular to the mating plug connector and comprises a metal cover, and an electric substrate received in the metal cover and electrical connected to the contacts of the mating plug connector.

Other objects, advantages and novel features of the invention will become more apparent from the following detailed description of a preferred embodiment when taken in conjunction with the accompanying drawings.

DETAILED DESCRIPTION OF THE INVENTION

Reference will now be made in detail to a preferred embodiment of the present invention.

Figure 1:
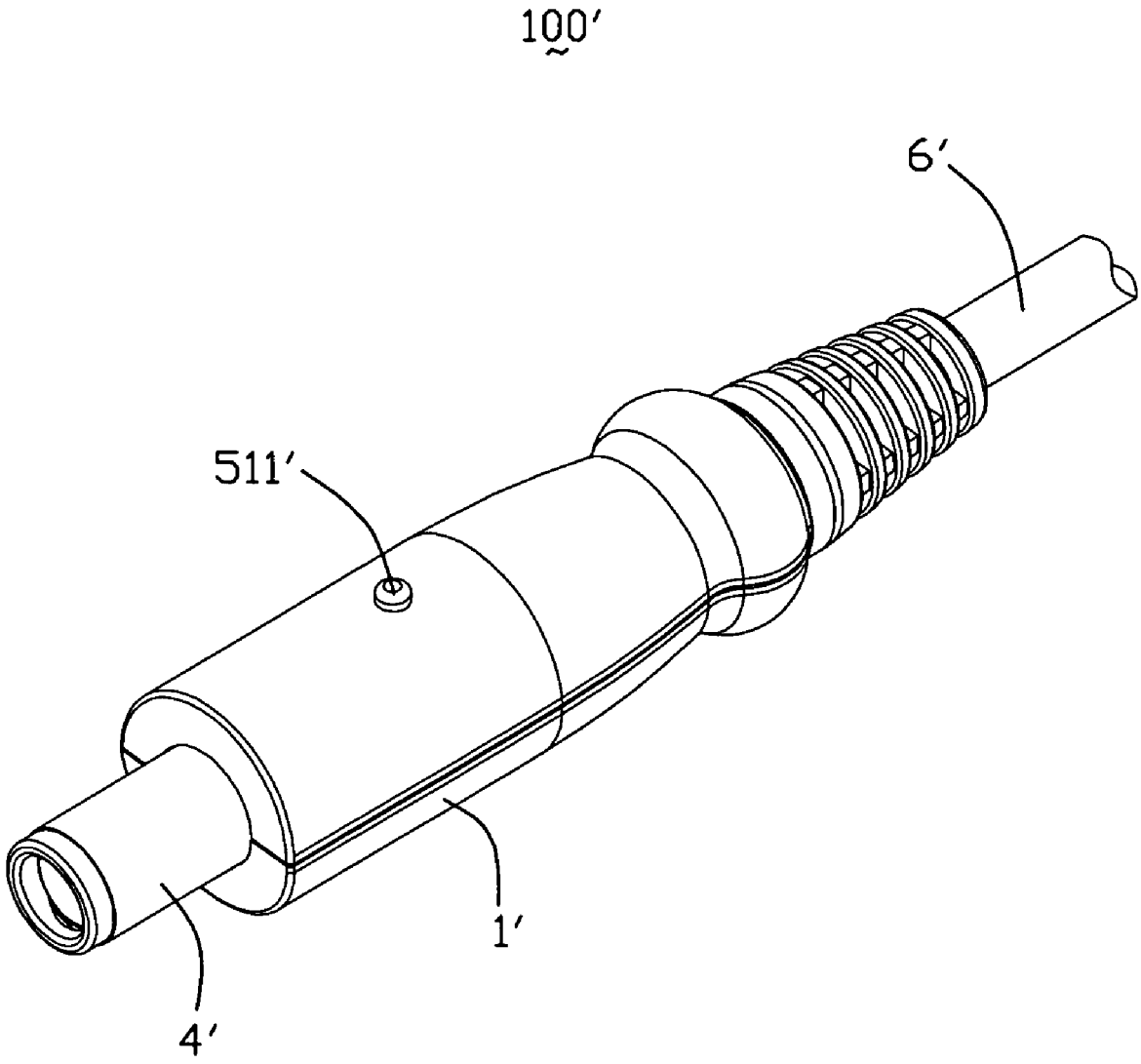
FIG. 1 (PRIOR ART)
FIG. 1 is a perspective view of a power cord cable assembly in according with a prior art.
Figure 2:
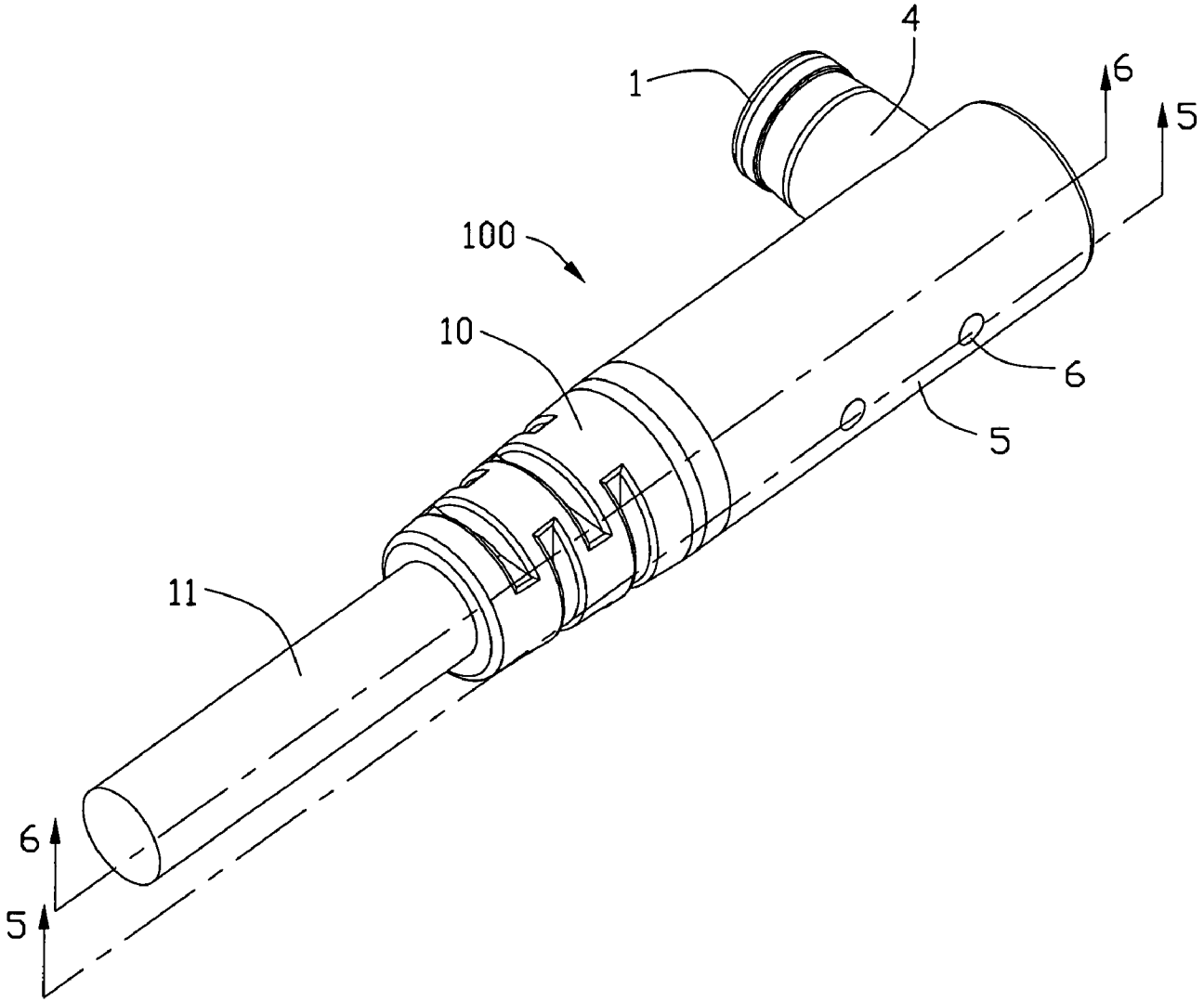
FIG. 2 is a perspective view of a power cord cable assembly in according with the present invention.
Figure 3:
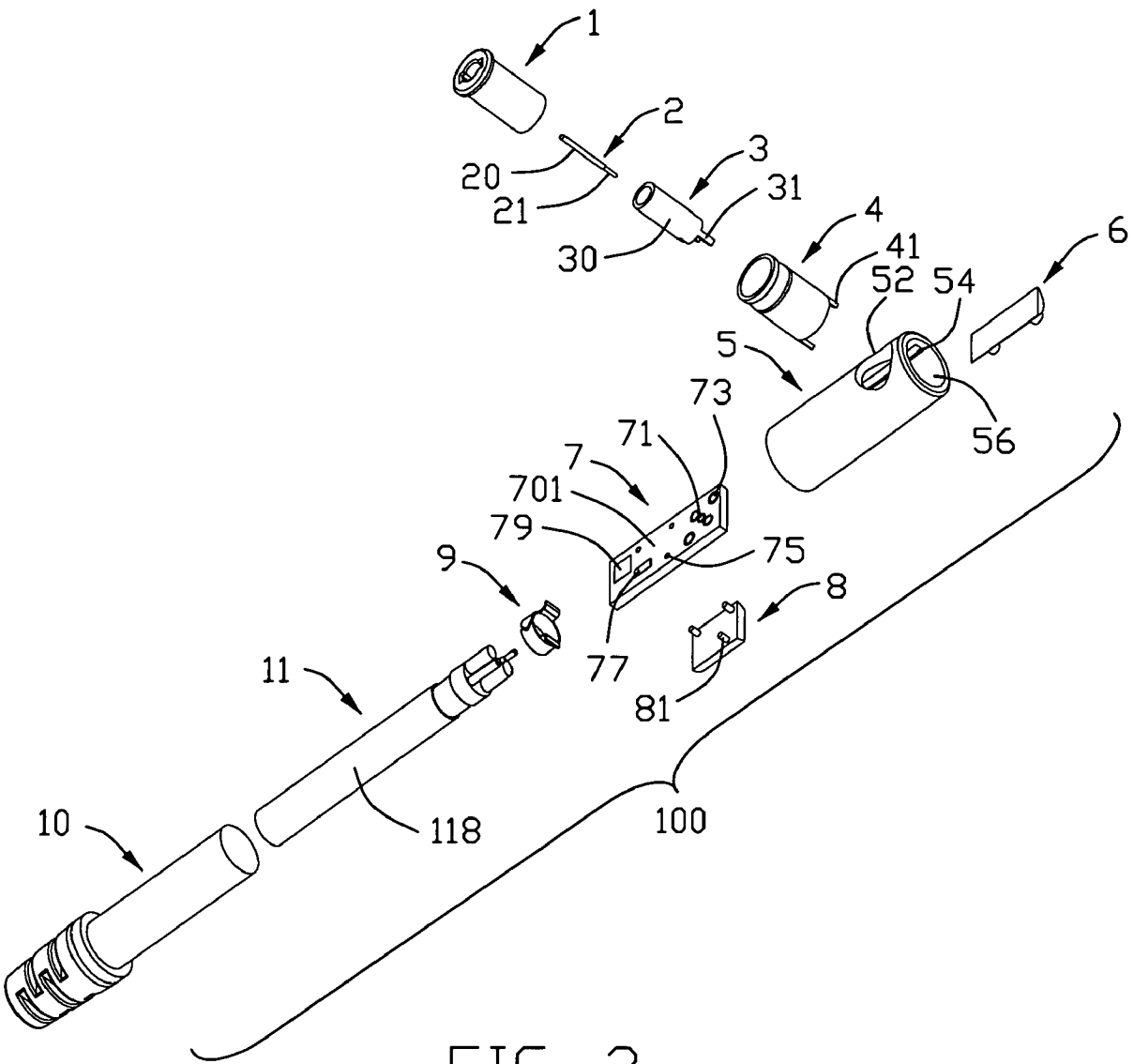
FIG. 3 is an exploded, perspective view of the power cord cable assembly in according with the present invention.
Figure 4:
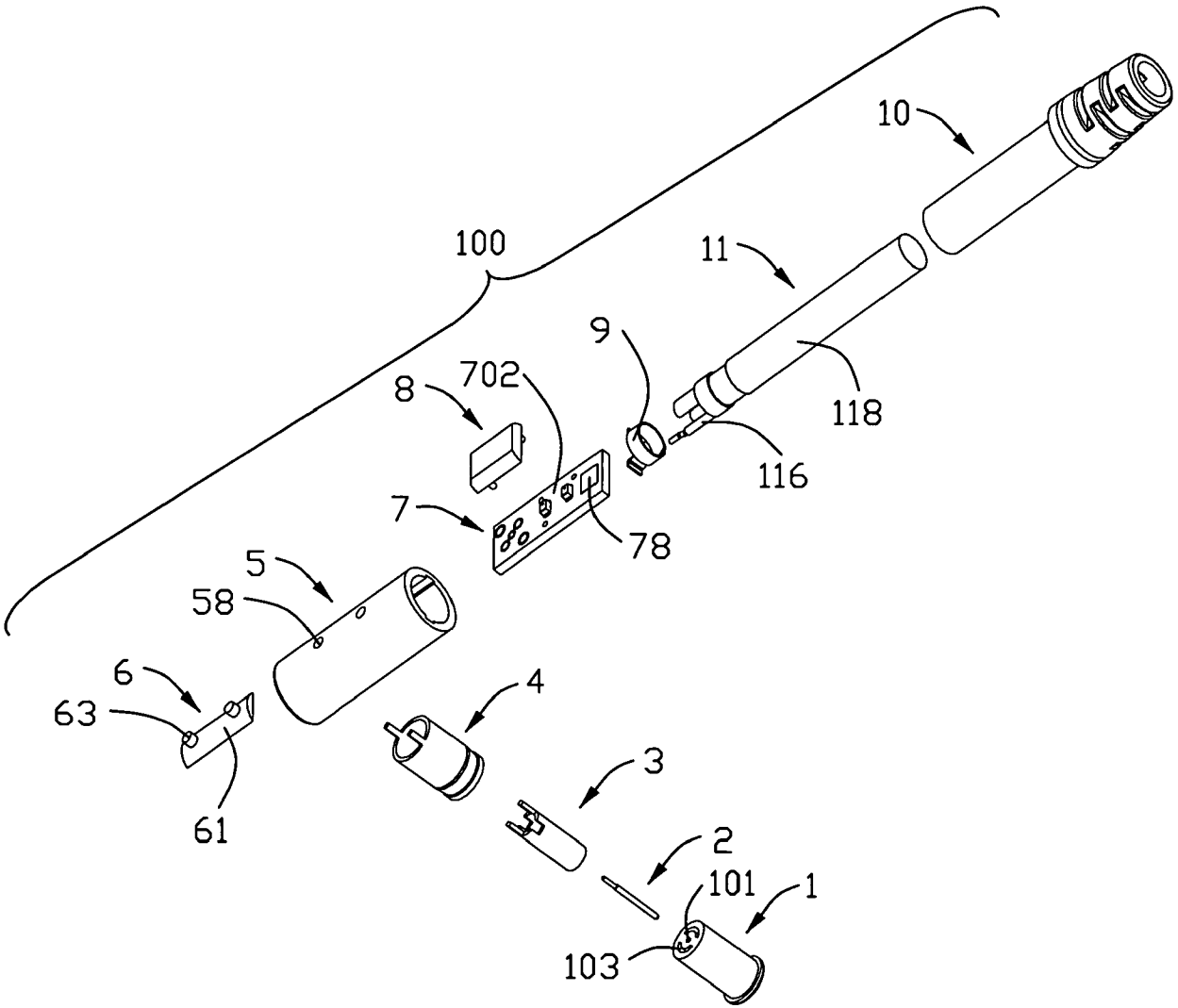
FIG. 4 is viewed similar to FIG. 3, but taken from different aspects.
Figure 5:
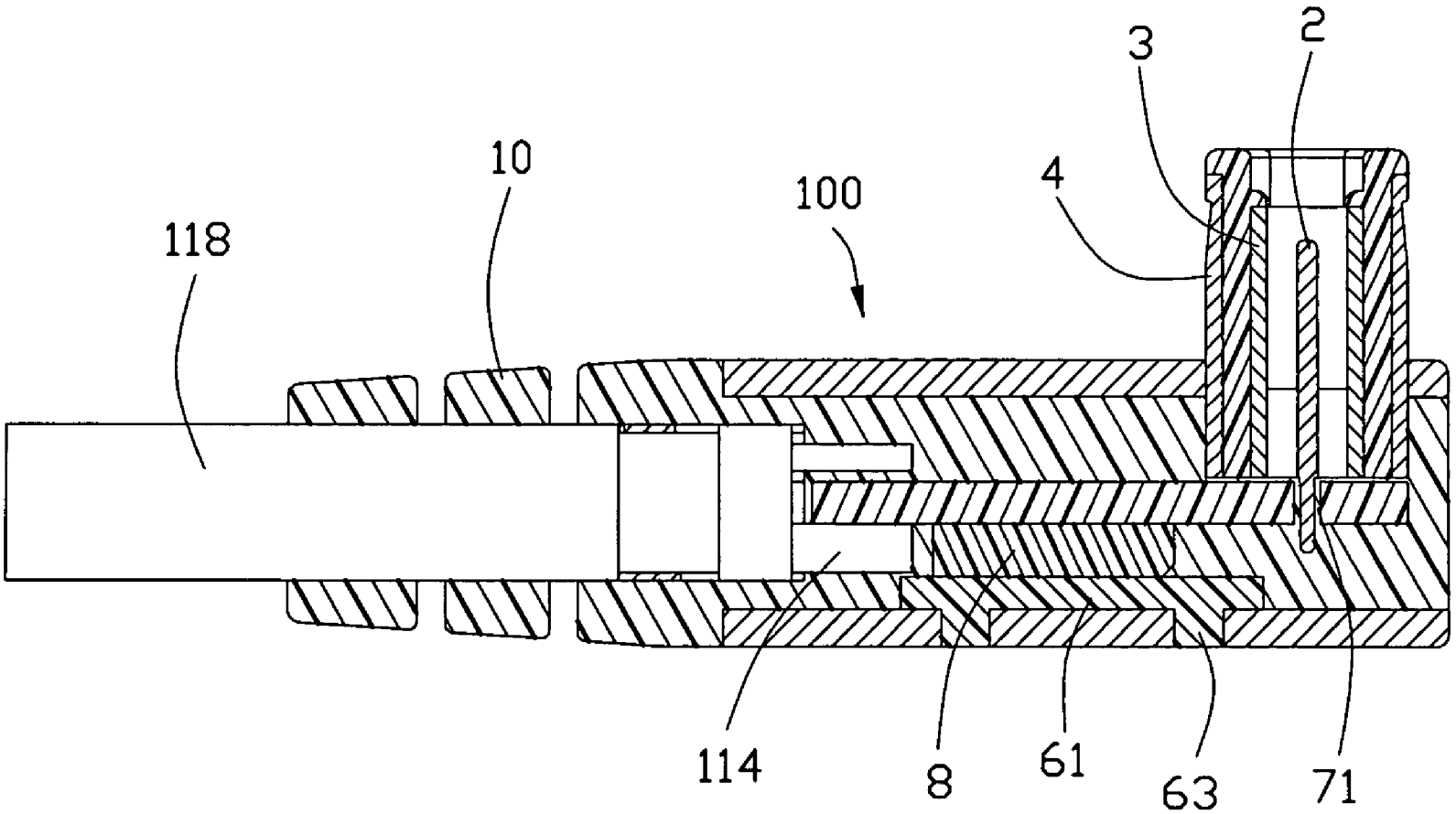
FIG. 5 is cross-section views of the power cord cable assembly taken along line 5-5 of FIG. 1.
Figure 6:
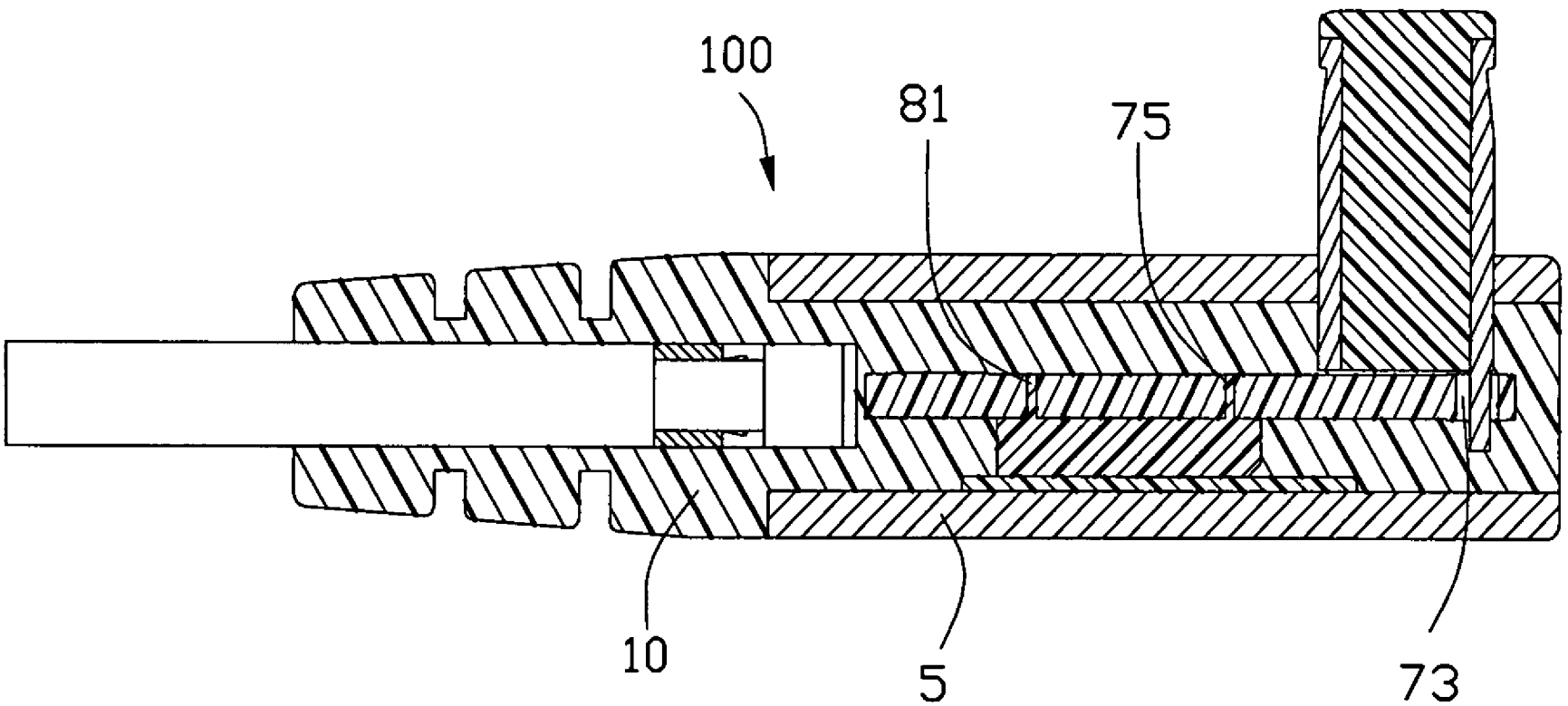
FIG. 6 is cross-section views of the power cord cable assembly taken along lines 6-6 of FIG. 1.

Referring to FIGS. 1 to 2, a power cord cable assembly 100 made in accordance with the present invention is used to exchange electrical signals when connected to the complementary connector (not shown). The cable assembly 100 comprises a housing 1, a first contact 2 received in center of the housing 1 for transmitting signals, a second contact 3 received in the housing and around the first contact 2 for transmitting power, a grounding shield 4 arranged around the housing 1, a metal cover 5 electrically connected to the grounding shield 4, a light pipe 6 received in the metal cover 5, a printed circuit board (PCB) 7 received in the metal cover 4, a Light-Emitting Diode (LED) mold 8 received in the metal cover 5, a cable 11, a crimp portion 9 increasing strain relief (SR) retention force and a dielectric mold 10 filled in the grounding shield 5.

Referring to FIGS. 2 to 6, the housing 1, which is made of insulative material, comprises a first receiving slot 101, a second receiving slot 103 surrounding the first receiving slot 101. The first contact 2 is of pin type and includes a main body 20 and a first connecting leg 21 extending from the main body 20 toward the PCB 7 along a direction perpendicular to the PCB 7. The main body 20 is received in the first receiving slot 101 of the housing. The second contact 3, which surrounds the first contact 2, includes a main portion 30 of columnar configuration and a pair of second connecting legs 31 extending from the main portion 30 toward the PCB 7 along a direction perpendicular to the PCB 7. The main portion 30 of the second contact 3 is received in the second slot 103, and the main body 20 of the first contact 2 is spaced apart from the main portion 30 of the second contact 3. The grounding shield 4, which surrounds the housing 1, includes a main section 40 and a pair of third connecting arms 41 extending from the main section 40 toward the PCB 7 along a direction perpendicular to the PCB 7.

The metal cover 5 is of cylindrical configuration with a receiving space 56 therein so as to form a surrounding wall 50. The metal cover 5 includes a passageway 52 for the housing 3 with the grounding shield 4, the first and second contacts 2, 3 to interferentially pass through the wall of the metal cover 5 so as to be assembled on the PCB 7, a guiding slot 54 extending along the lengthwise direction thereof, and two receiving holes 58 on the surrounding wall 50 opposite to the passageway 52 and connecting the receiving space 56 and the outer space. The PCB 7 is inserted into the metal cover 5 along the guiding slot 54 and received in the receiving space 56.

The PCB 7 has a first surface 701 and a second surface 702. The housing 1 along with the first, second and third contacts 2, 3, 4 is mounted on the first surface 702 of the PCB 7. The PCB 7 comprises a plurality of connecting holes 71, 72, 73 located on one end of the PCB 7 and respectively corresponding to the first, second, third connecting legs 21, 31, 41 of the first, second, third contacts 2, 3, 4. And the connecting legs 21, 31, 41 can be respectively fixed in the connecting holes 71, 72, 73 and electrically connected to the circuit (not shown) on the PCB 7. A plurality of pads are arranged on the PCB 7 and adjacent to the other end of the PCB 7 opposite to the holes 71, 72, 73. A first pad 77 is arranged on the first surface 701 of the PCB 7, a second pad 79 is located on the first surface 701 of the PCB 7 and spaced apart from the first pad 77, and a third pad 78 located on the second surface 702 of the PCB 7. A plurality of mounting holes 75 is located between the connecting holes 71, 72, 73 and the pads 77, 78,

79. The LED mold 8 has a plurality of mounting legs 81 corresponding to the mounting holes 75 for being fixed on the PCB 7 through the insertion of the mounting legs 81 into the mounting holes 75. The light pipe 6 has a transmission portion 61 connected to the LED mold 8 and a pair of lights 63 extending from the transmission portion 61 and is received in the receiving holes 58 of the grounding shield 5.

The cable 11 includes a first wire 110 connected to the first pad 77 for transmitting signals, a second wire 112 connected to the third pad 79 for transmitting power, a third wire 114 connected to the second pad 78 for grounding, a plurality of inner jacket 116 corresponding to the wires 110, 112, 114 for respectively covering the wires 110, 112, 114, and an outer jacket 118 covering all the wires 110, 112, 114 and inner jackets 116. In this embodiment, the wires 110, 112, 114 are soldered on the PCB 7, and the crimp portion 9 is of ring type and crimps the jacket 118 of the cable 11 for increasing strain relief (SR) retention force and preventing the jacket 118 from loosing.

The dielectric mold 10 is molded to fill into the metal cover 5 and covering the PCB 7 and the wires 110, 112, 114.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A plug connector for mating with a complementary connector, comprising:

a mating plug connector, comprising a housing, a plurality of contacts received in the housing and spaced apart from each other, and a grounding shield surrounding the housing; and an electrical connector, being perpendicular to the mating plug connector and comprising a metal cover, and an electric substrate received in the metal cover and electrically connected to the contacts of the mating plug connector;

wherein said contacts are composed of a first contact received in a center of the housing for transmitting signals, a second contact received in the housing and around the first contact for transmitting power and each of the contacts comprises at least a connecting leg electrically connected to the electric substrate;

wherein said grounding shield comprises a pair of connecting legs electrically connected to the electric substrate; and wherein said contacts and grounding shield are attached on one surface of the electric substrate and said plug connector further comprises a Light-Emitting Diode (LED) mode attached on other surface of the electric substrate and a light pipe connected to the LED mode.

2. The plug connector as claimed in claim 1, wherein said metal cover comprises a receiving space and at least one hole connecting the receiving space and the outer space of the metal cover, and the light pipe comprises at least one light received in the hole.

3. A cable assembly, comprising:

a mating plug connector, comprising a housing, a plurality of contacts received in the housing and spaced apart from each other, a grounding shield surrounding the housing;

an electrical connector, comprising a metal cover having a receiving space and an electric substrate received in the metal cover and electrical connected to the contacts of the mating plug connector;

a cable, comprising a plurality of wires respectively electrically connected to the electric substrate; and a dielectric mold filled in the receiving space of the metal cover of the electrical connector;

wherein said mating plug connector is perpendicular to the electrical connector;

wherein said contacts are composed of a first contact received in a center of the housing for transmitting signals, a second contact received in the housing and around the first contact for transmitting power and each of the contacts comprises at least a connecting leg electrically connected to the electric substrate;

wherein said grounding shield comprising a pair of connecting legs electrically connected to the electric substrate; and wherein said contacts and grounding shield are attached on one surface of the electric substrate, said plug connector further comprises a Light-Emitting Diode (LED) mode attached on other surface of the electric substrate and a light pipe connected to the LED mode.

4. The cable assembly as claimed in claim 3, wherein said metal cover comprises at least one hole connecting the receiving space and the outer space of the housing, and the light pipe comprises at least one light received in the hole.

* * * * *